US007462063B1

(12) United States Patent
Correll

(10) Patent No.: US 7,462,063 B1
(45) Date of Patent: Dec. 9, 2008

(54) MODULAR TERMINAL BLOCK

(75) Inventor: Michael A. Correll, Hershey, PA (US)

(73) Assignee: Phoenix Contact Development & Manufacturing, Inc., Middletown, PA (US)

( * ) Notice: Subject to any disclaimer, the term of this patent is extended or adjusted under 35 U.S.C. 154(b) by 0 days.

(21) Appl. No.: 11/831,147

(22) Filed: Jul. 31, 2007

(51) Int. Cl.
*H01R 13/58* (2006.01)

(52) U.S. Cl. ..... 439/460

(58) Field of Classification Search ..... 361/112, 361/117, 118, 119, 126, 127, 728, 823, 824; 174/51, 52.1, 52.2; 439/95, 97, 108, 389, 439/391, 409–413, 572, 709, 915, 460
See application file for complete search history.

(56) References Cited

U.S. PATENT DOCUMENTS

| | | | | |
|---|---|---|---|---|
| 3,247,480 | A | 4/1966 | Orzechowski | |
| 4,637,676 | A | 1/1987 | Simonsen et al. | |
| 4,898,550 | A | 2/1990 | Ayer | |
| 6,222,717 | B1 * | 4/2001 | Waas et al. | 361/119 |
| 6,332,813 | B1 * | 12/2001 | Okabe et al. | 439/701 |
| D473,519 | S * | 4/2003 | Borst | D13/147 |
| 6,733,330 | B2 | 5/2004 | Prost et al. | |
| 6,802,737 | B2 * | 10/2004 | Bergner et al. | 439/532 |

OTHER PUBLICATIONS

Phoenix Contact Inc., USA, "living hinge" screw opening cover, drawing No. 00084610, 1 page.
Phoenix Contact Inc., USA, product catalog, printed circuit terminal block, order No. 1730638, product catalog, 6 pages.
Phoenix Contact Inc., USA, printed circuit terminal block, order No. 1869910, product catalog, 4 pages.
Phoenix Contact Inc., USA, standard 1:1 D-SUB module, order No. 2302984, product catalog, 4 pages.
Phoenix Contact Inc., USA, VARIOFACE module, order No. 2962544, product catalog, 4 pages.
Phoenix Contact Inc., USA, pluggable four-level spring-cage terminal block, order No. 3041995, product catalog, 2 pages.

* cited by examiner

*Primary Examiner*—Edwin A. Leon
(74) *Attorney, Agent, or Firm*—Hooker & Habib, P.C.

(57) ABSTRACT

A modular terminal block for connecting leads or wires to an electrical body includes a module stack of side-by-side module assemblies and an alignment plate. Each module assembly includes a housing, a number of conductors extending from the housing, and a cover member to cover the conductors. The alignment plate accurately positions the conductors despite variations in housing dimension due to manufacturing tolerances. The housing includes walls supported on both sides when forming part of the module stack. The walls resist deflection of the conductors during installation of the alignment plate and electrical body. Each cover member engages and is held closed by a conductor extending from the housing.

15 Claims, 17 Drawing Sheets

MODULAR TERMINAL BLOCK

FIELD OF THE INVENTION

The invention relates to a terminal block for forming electrical connections between a set of wires or leads and an electrical body having an array of contacts to be connected to the set of wires or leads.

BACKGROUND OF THE INVENTION

Terminal blocks form electrical connections between a set of leads and an electrical body having an array of contacts. The terminal block includes a terminal housing, receptacles in the housing to receive the leads, and electrical conductors extending from the receptacles out of the housing. The exposed conductors are arranged to engage the contacts of the electrical body.

Modular terminal blocks have the terminal housing formed from a module stack made of a number of like slices or housing modules. Each module contains a set of receptacles and a set of conductors. The modules are placed or stacked side-by-side, with end plates closing the ends of the module stack to form the terminal housing.

The electrical body, which may be a printed circuit board, is connected to the conductors of the module stack. The conductors extend through plated contact holes or vias in the circuit board to electrically interconnect the receptacles with the circuit board.

The widths of the housing modules making up a module stack vary due to manufacturing tolerances. As a result, the overall length of the module stack and the positioning of the modules in the stack will also vary among different module stacks that are intended to connect with the same type of circuit board. The module stack may be made up of a relatively large number of housing modules, and tolerance buildup along the stack may cause misalignment of the conductors. The positions of the conductors may not accurately correspond or align with the predetermined arrangement of vias on the circuit board.

The circuit board is placed above the module stack with the vias positioned above the corresponding conductors. As module stacks are getting longer and longer, manufacturing tolerances may result in some conductors not accurately aligned with the vias in the circuit board. The misaligned conductors may be damaged during insertion or may even prevent the circuit board from being installed.

The circuit board is moved toward the module stack, with the conductors entering the vias of the circuit board. The conductors and vias are sized to generate a press fit that electrically connects the conductors with the circuit board.

The press fits generated between the conductors and the circuit board applies forces on the conductors that tend to cause the conductors to bend or deflect in the housings. As the module stacks get longer and the number of conductors increase, the deflection of the conductors makes it even more difficult to maintain proper conductor alignment during installation. Conductors may be damaged or insertion forces may exceed acceptable levels.

Terminal housings include covers that close to cover the conductors and the contact portion of the circuit board. The cover is held closed by the end plates attached to the module stack after the circuit board is installed on the conductors. As the module stacks get longer, however, the cover has a tendency to bow upward between the end plates and expose the contacts.

Thus there is a need for a modular terminal block having an improved modular terminal housing. The improved terminal housing should assure accurate alignment of the conductors with the vias despite manufacturing tolerance buildup along the module stack. The conductors should be better supported in the housing modules to resist deflection of the conductors during attachment of the circuit board. The terminal housing cover should remain closed along its entire length after the circuit board is attached to the module stack.

SUMMARY OF THE INVENTION

The invention is a modular terminal block having an improved modular terminal housing. The improved terminal housing assures accurate alignment of the conductors with the vias despite manufacturing tolerance buildup along the module stack. The conductors are better supported in the housing modules to reduce deflection of the conductors during installation of the circuit board. The terminal housing cover remains closed along its length after the circuit board is attached to the module stack.

A modular terminal housing in accordance with the present invention includes a number of module assemblies and an alignment member. Each module assembly includes a housing module and at least one conductor extending out of the module. The modules are aligned with one another.

The alignment member includes a number of surfaces in a predetermined arrangement. The conductors are engageable with the surfaces to position the conductors in the predetermined arrangement for connection of the conductors to the contacts of the electrical component.

In a preferred embodiment of the invention the conductors have some freedom of movement with respect to their respective housing modules to enable the alignment member to position the conductors without deforming the conductors.

The alignment member is preferably a plate having a thickness less than the distance the conductors extend out of the housing modules. The alignment plate has a number of apertures that receive the conductors and conductor positioning surfaces on the walls of the apertures. The alignment plate is movable against the modular housings to permit the conductors to extend through the plate so that the electrical component can be connected to contact portions of the conductors located above the alignment plate. The apertures preferably have enlarged openings to receive the conductors, facilitating automated installation of the alignment plate.

The conductors preferably have narrowed conductor portions that are in the apertures when the alignment plate is against the housing modules. The narrowed conductor portions do not touch or engage the aperture walls, permitting the alignment plate to "float" with respect to the conductors when the electrical body is attached to the conductors. The alignment plate remains part of the assembly, sandwiched between the module stack and the electrical body.

In preferred embodiments of the invention the conductors are sized to form press fits with the alignment member and the electrical body. The press fits apply loads against the conductors during installation of the alignment member and electrical body.

Preferably each housing module has a conductor housing that includes one or more walls that support the one or more conductors in the housing. The walls resist deflection of the conductors from the press fit forces. In preferred embodiments each wall extends the width of the housing and the wall is supported on both sides when the housing module forms part of the module stack. Piers or aligned support members aligned with the external conductor portions can transmit the forces directly to an outer module wall.

Each conductor housing preferably includes a cover member that is movable between open and closed positions to cover the conductors extending from the housing. The cover members engage one another along the module stack to define a cover movable between open and closed positions. The module stack includes a number of cover retention members spaced along the stack that engage and retain the cover when the cover is in the closed position. The cover is held closed at multiple points between the end plates to resist opening of the cover.

In preferred embodiments each cover member includes a retention member so that each cover member is independently held in the retained position. The retention member is preferably one of the exposed conductor portions extending from the housing. The cover member and the conductor portion have cooperating retention surfaces that engage one another to hold the cover member in its closed position.

The modular terminal block of the present invention has a number of advantages. The modular stack can be made longer and made with more slices, with the alignment member assuring the conductors are properly located without damage for connection with the electrical body. The electrical body can be reliably installed by automated machinery, even for relatively long module stacks.

Deflection or bending of the conductors within the conductor housing during installation of the alignment member and electrical body are resisted by supporting the conductors on walls and other support members in the housing. This helps facilitate automated assembly of the alignment member and electrical body even when the module assembly includes a large number of conductors.

The cover remains reliably closed along the length of the cover after the cover is closed. Spacing the cover retention members along the length of the cover prevents gaps or bows in the cover. By having the conductors themselves form the cover retention members, no modifications to the electrical body to clear the retention members are required, and the cover member of each module assembly is held closed independently of the other cover members.

Other objects and features of the invention will become apparent as the description proceeds, especially when taken in conjunction with the accompanying seventeen sheets of drawings illustrating an embodiment of the invention.

DESCRIPTION OF THE PREFERRED EMBODIMENT

Figure 1:
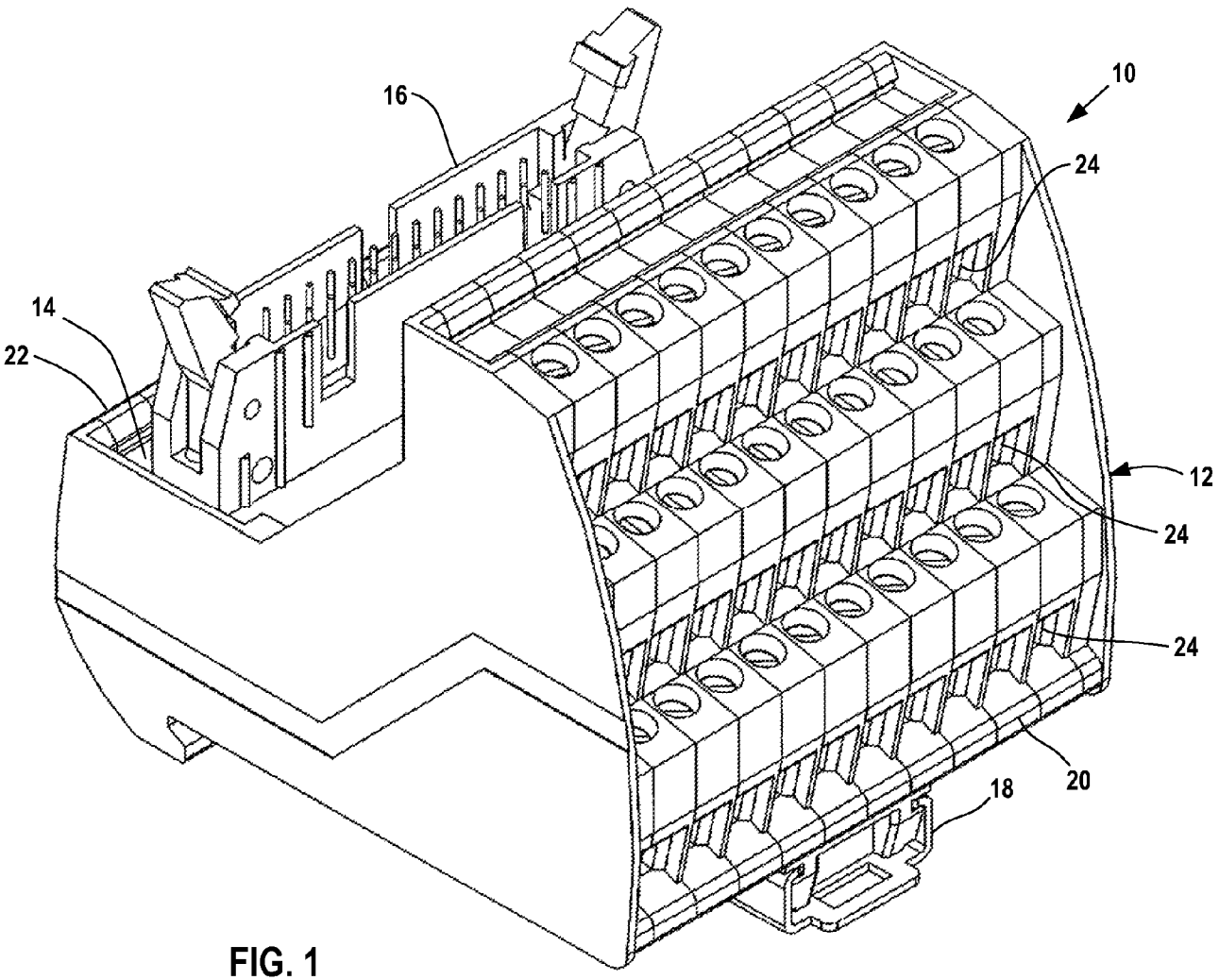
FIG. 1 is a perspective view showing the front of a modular terminal block in accordance with the present invention.
Figure 2:
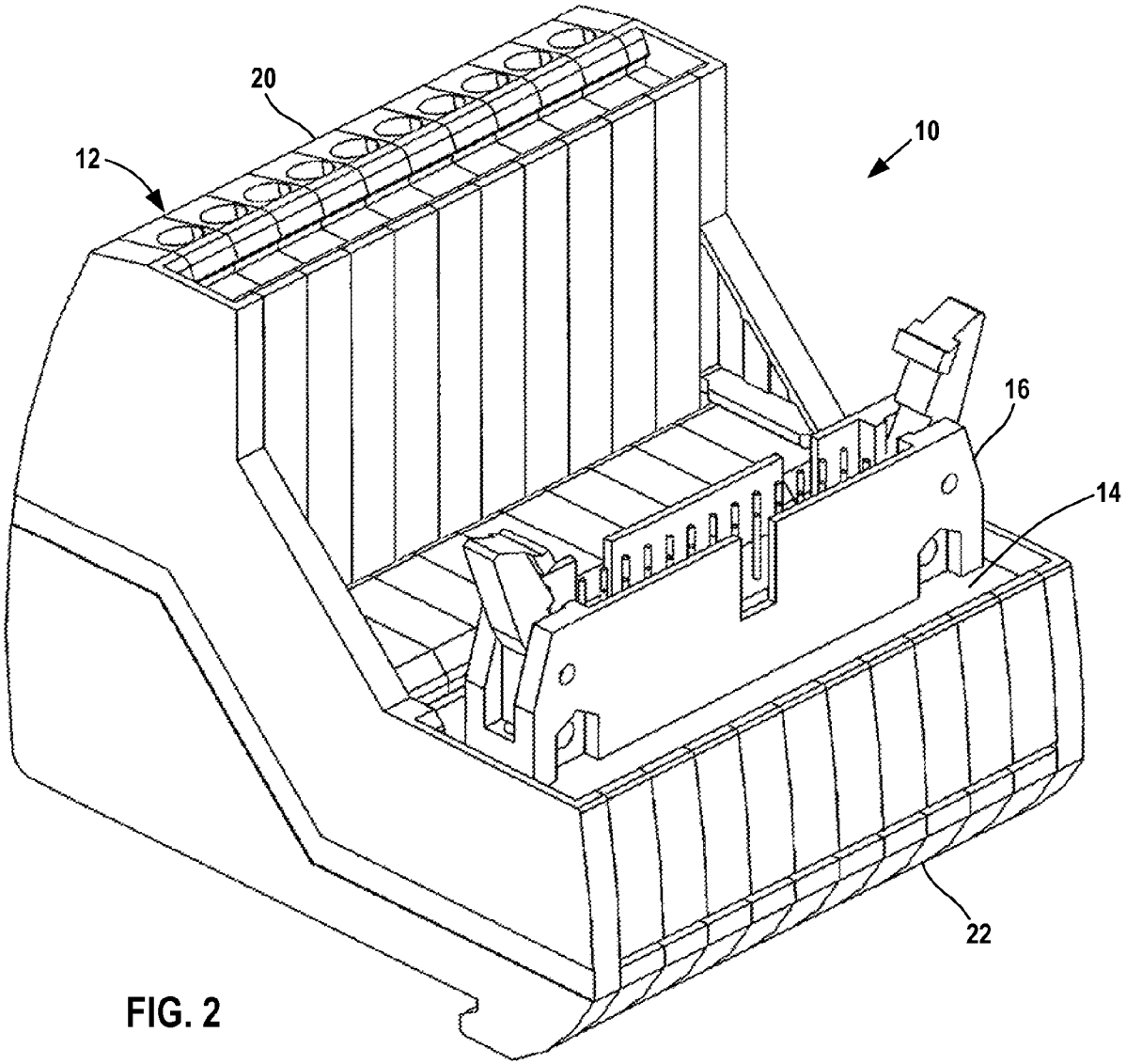
FIG. 2 is a perspective view showing the back of the terminal block.

FIGS. 1 and 2 illustrate a terminal block 10 in accordance with the present invention. Terminal block 10 includes an electrical terminal housing 12 and a printed circuit board 14 permanently mounted on the housing 12. A number of electrical conductors extend from the terminal housing 12 and through a rectangular array of vias in the circuit board 14 as will be described in greater detail below. The conductors electrically connect the terminal housing 12 and the printed circuit board 14.

The printed circuit board 14 has a socket 16 for receiving an electrical component to be connected to the terminal block 10. Socket 16 is attached to a printed circuit board, but other types of sockets can be used with the terminal housing 12 to connect terminal block 10 to other types of electrical bodies.

Terminal block 10 is preferably configured for mounting on a conventional DIN rail and includes a DIN latch 18 for mounting the terminal block on the DIN rail.

Terminal housing 12 has a front input/output end 20 and a back control end 22 that supports the printed circuit board 14. I/O end 20 carries a number of electrical receptacles 24 arranged in a multi-level or multi-story arrangement. Illustrated terminal housing 12 is a three-story housing, but other embodiments may have more or fewer stories. The electrical conductors extend through the housing 12 and electrically connect the receptacles 24 with the circuit board 14.

Figure 3:
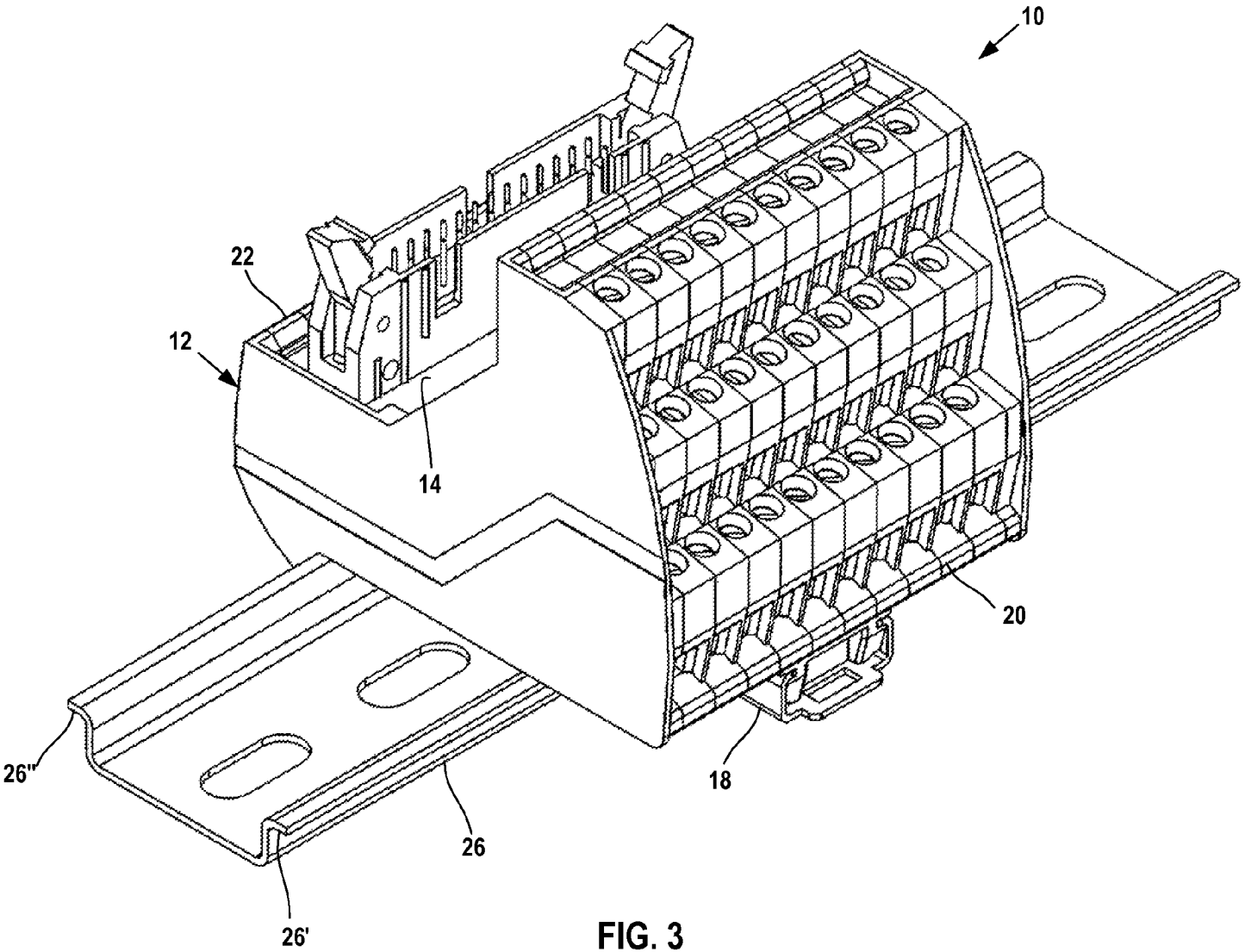
FIG. 3 is similar to FIG. 1 illustrating the terminal block mounted on a DIN rail.
Figure 4:
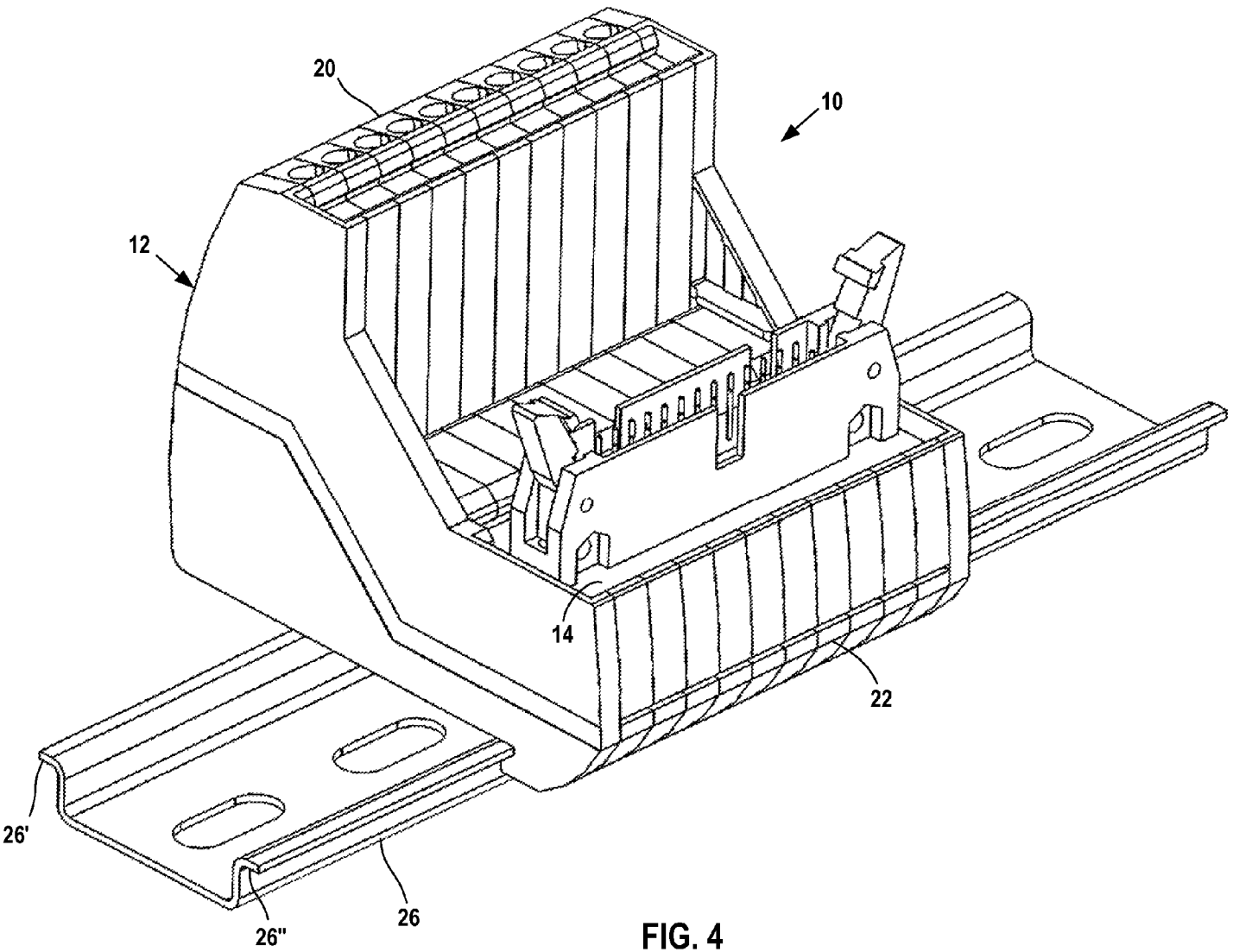
FIG. 4 is similar to FIG. 2 illustrating the terminal block mounted on the DIN rail.

FIGS. 3 and 4 illustrate terminal block 10 mounted on a DIN rail 26. Rail 26 has mounting flanges 26', 26". The terminal housing 12 hooks onto one flange 26' and the DIN latch 18 attaches to the other flange 26".

Figure 5:
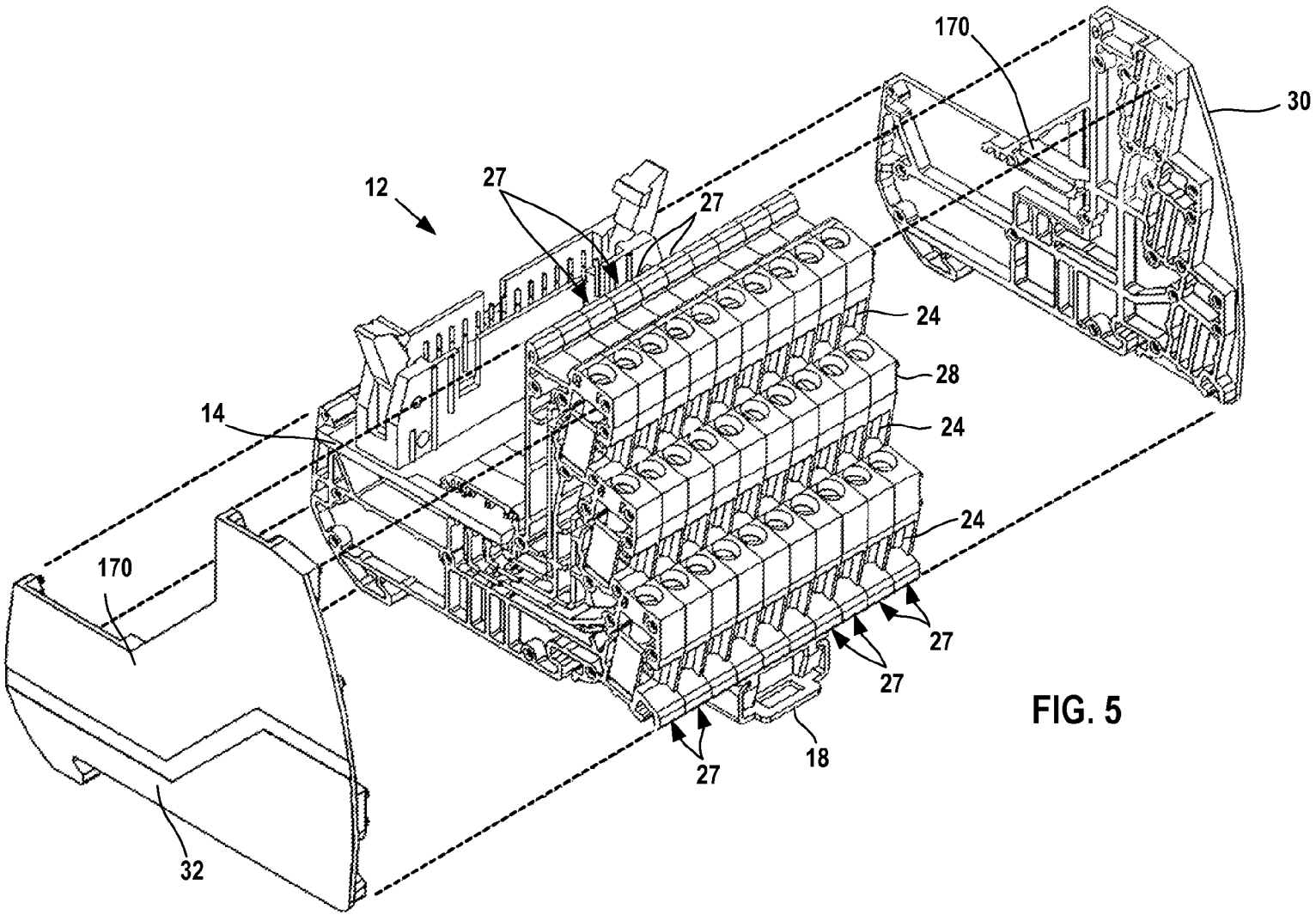
FIG. 5 is an exploded view of FIG. 1.
Figure 6:
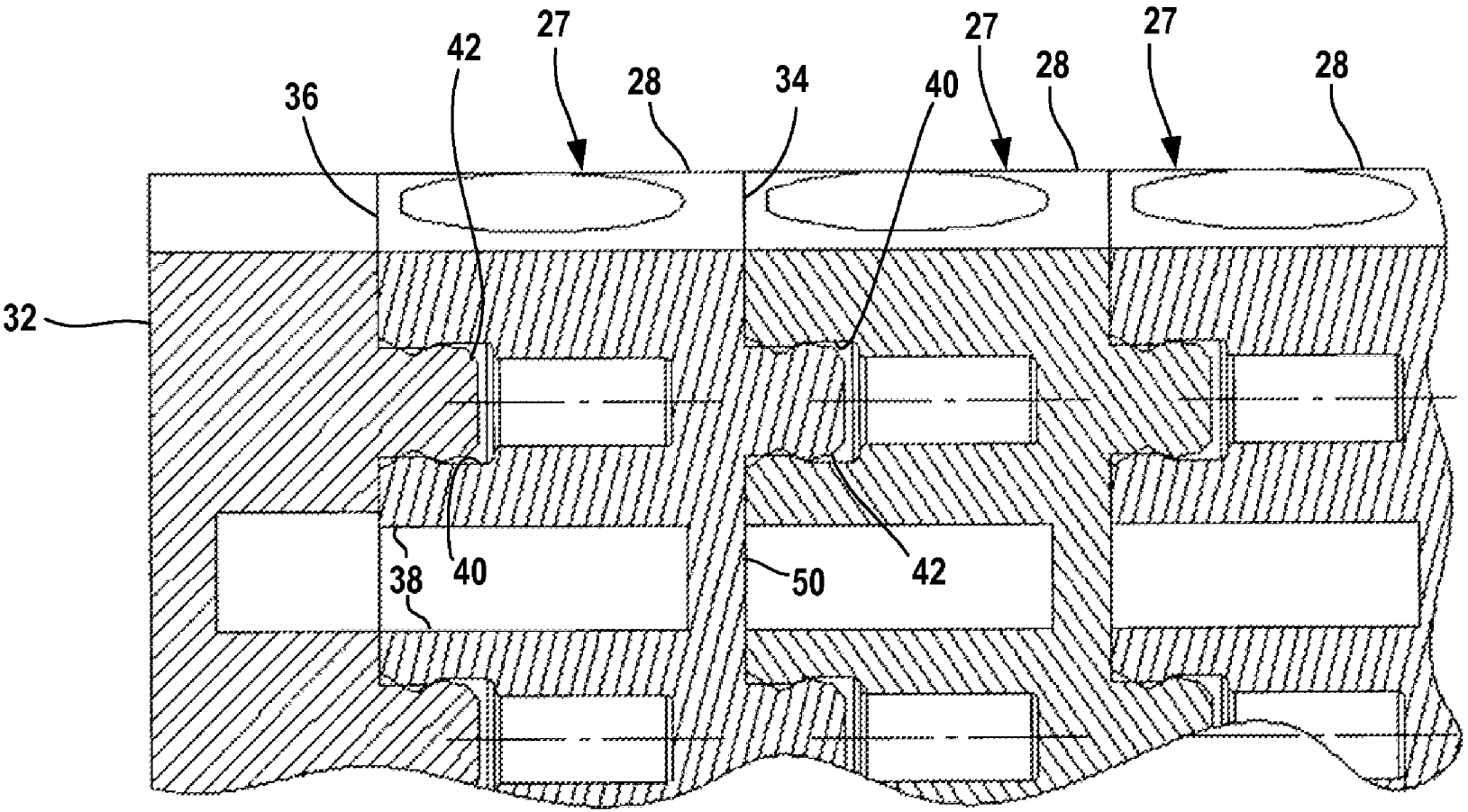
FIG. 6 is a vertical sectional view of a portion of an end plate and module stack forming part of the terminal housing of the terminal block.

Terminal housing 12 has a modular construction and is made up of a number of identical slices or module assemblies 27 sandwiched between left and right endplates 30 and 32. See FIGS. 5 and 6. The modular assemblies 27 each include a housing module 28 that holds a set of receptacles 24. The illustrated terminal housing 12 is made up of ten module assemblies 27. Other terminal block embodiments may have more or fewer module assemblies 27. The set of module assembles 27 also cooperate to hold the DIN latch 18.

Each module 28 is a multi-story slice or housing that holds three electrical receptacles 24. The illustrated module 28 is a three-story module, with each story holding one receptacle 24. Other embodiments of module 28 may have more or fewer stories, or may have different arrangements of receptacles 24.

Figure 7:
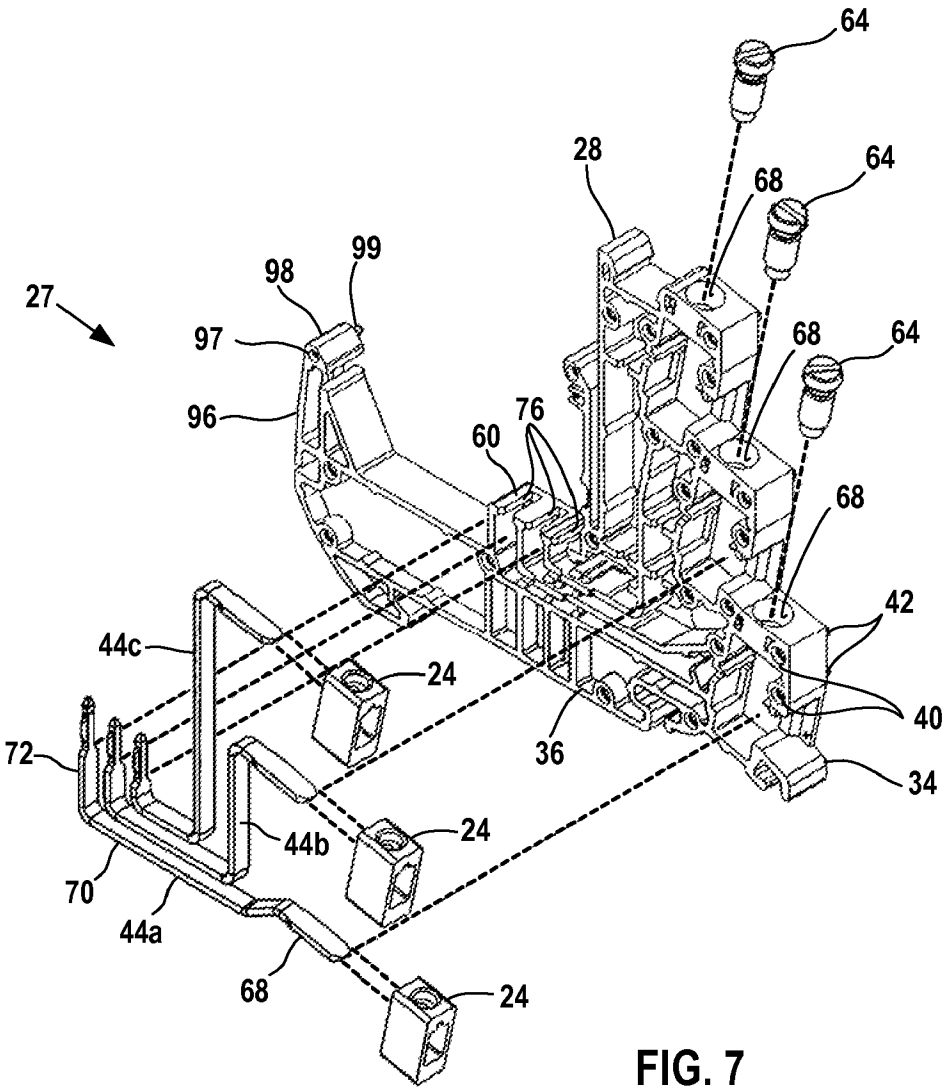
FIG. 7 is an exploded view of a module assembly forming part of the module stack of the terminal block.
Figure 8:
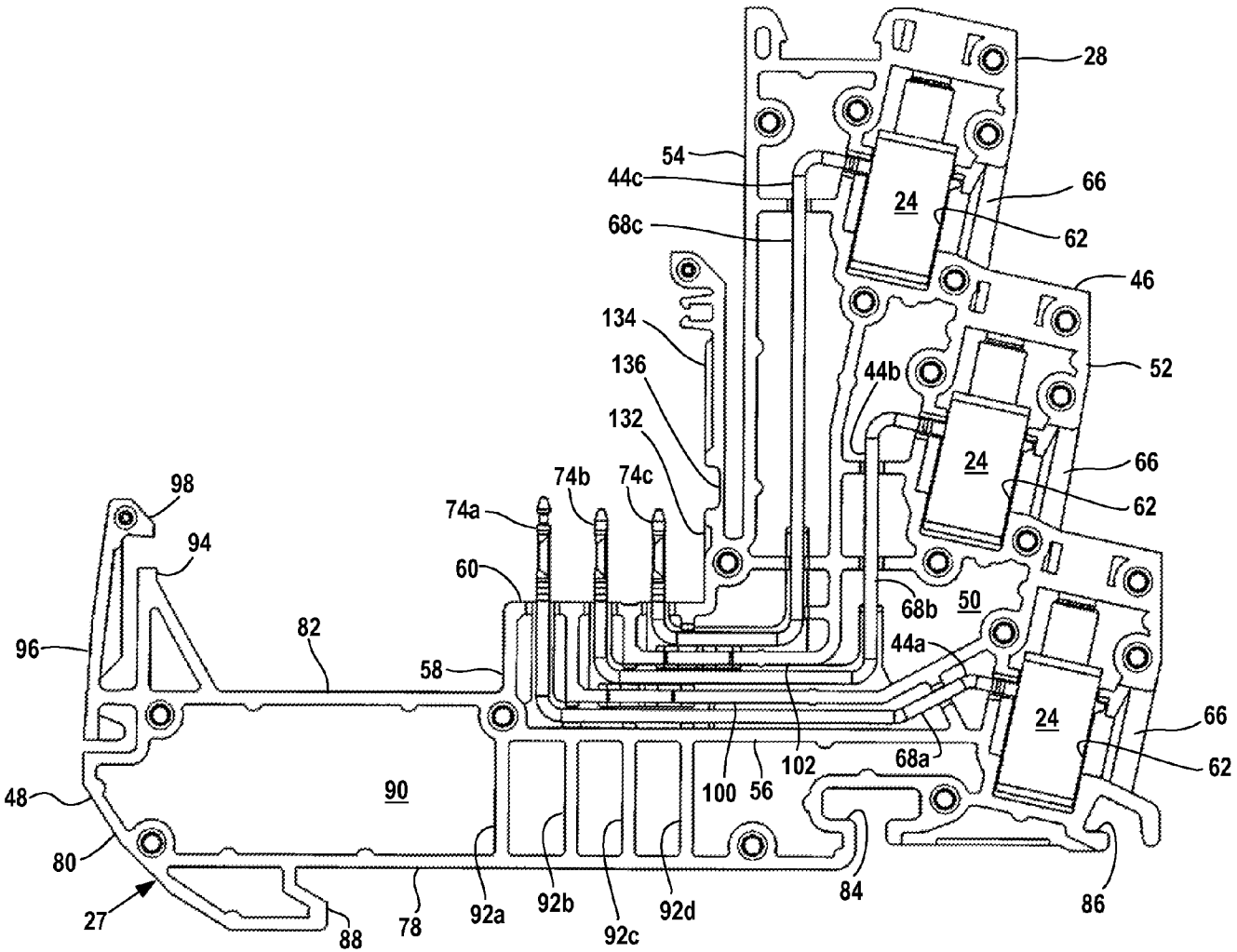
FIG. 8 is a side view of the module assembly.
Figure 9:
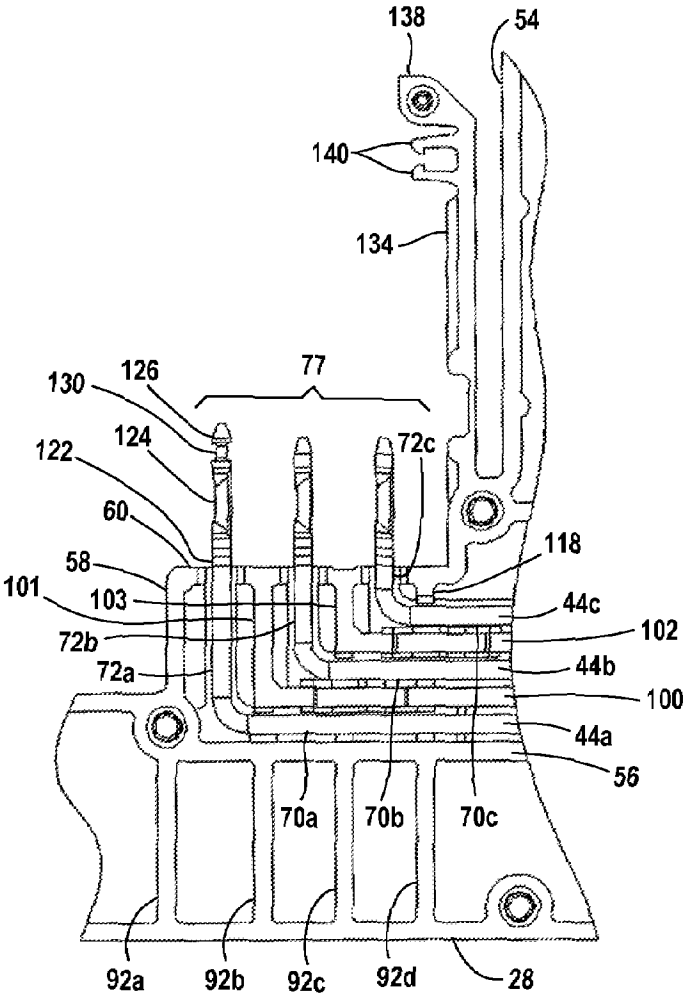
FIG. 9 is an enlarged view of a portion of FIG. 8 illustrating the conductors extending out of the module housing.
Figure 10:
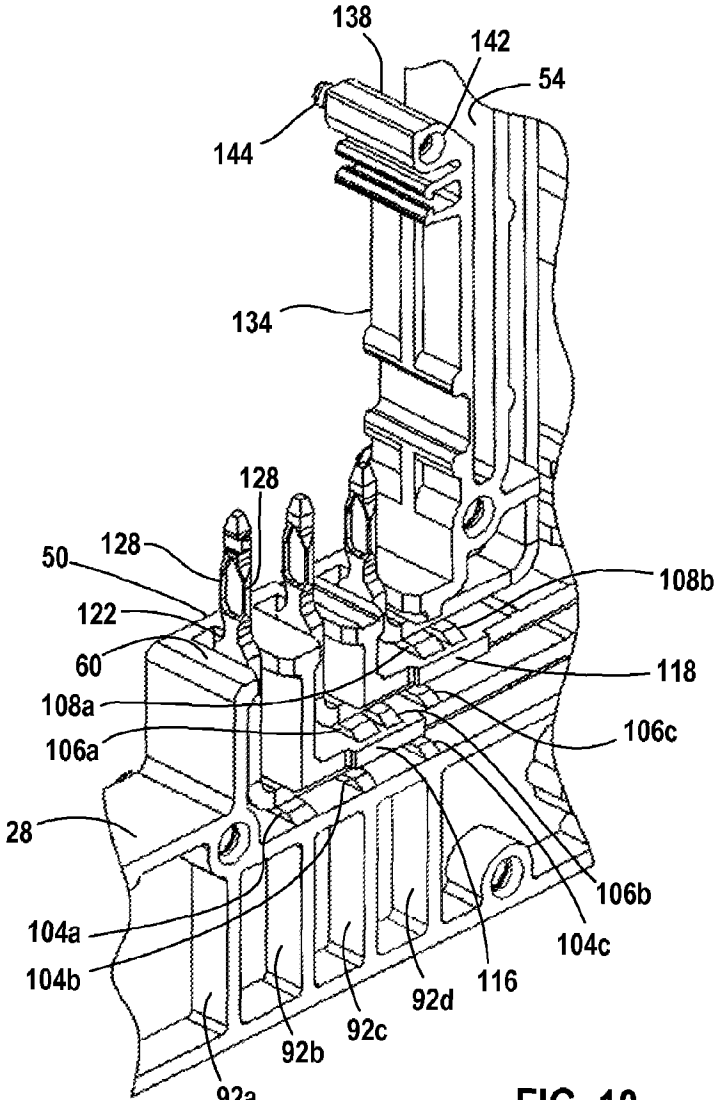
FIG. 10 is similar to FIG. 9 but a perspective view.

Module 28 is an integral one-piece member molded from a non-conducting plastic. Module 28 has a uniform width or thickness extending between a first side 34 and an opposite side 36. A number of spaced apart alignment bodies 38 extend between sides 34 and 36 to align the module 28 with an adjacent module 28 or end plate 30 or 32. Each body 38 includes an open bore 40 facing one side of the module and a plug 42 extending away from the other side of the module (see also FIG. 7). Plugs 42 of an adjacent module or end plate are received in the bores 40 while plugs 42 are received in the bores 40 on an adjacent module or end plate to form the terminal housing 12.

FIGS. 7-10 illustrate a module assembly 27 prior to its being installed as part of terminal housing 12. Three conductors 44*a*, 44*b*, 44*c* electrically connect the three receptacles 24 in the module 28 with the printed circuit board 14.

Module 28 includes a front conductor housing 46 that houses the receptacles 24 and conductors 44, and a base portion 48 that supports the module 28 on the DIN rail 26.

Front housing 46 extends across the full width of the module 28. First housing side 34 is closed by a sidewall 50. Second housing side 36 is open so that conductors and receptacles can be inserted into the module. When the modules 28 are stacked together to form terminal housing 12, the open side 36 is closed by an adjacent module sidewall 50 or by the endplate 32 (see FIG. 6).

Front housing 46 includes a front wall 52, a back vertical wall 54, and a lower horizontal wall 56. A vertical end wall 58 extends from the lower wall 56 to an upper horizontal wall 60 that extends from the end wall 58 to the foot of the vertical wall 54.

Front wall 52 defines a multi-story set of receptacle compartments 62 that each receives a receptacle 24. Illustrated receptacles 24 are conventional screw terminals having screws 64 that tighten against the conductors 44 and raise the receptacles 24 against wires or leads inserted into the receptacles. Each receptacle compartment 62 includes a front opening 66 for receiving a wire into the receptacle and a bore 68 that receives a screw 64 with an interference fit. Each higher compartment 62 is spaced progressively towards the back wall 54 to permit tool access to the screws 64.

Conductors 44 are formed strip conductors or bus bars having a generally rectangular cross section. Each conductor 44*a*, 44*b*, 44*c* includes a lead segment 68 that extends from a receptacle housing 62, a horizontal segment 70, and a vertical segment 72 bent upwardly ninety degrees from the horizontal segment. The upper end portion of each vertical segment 72 has a reduced cross section that defines a pin portion or conductor pin 74.

The conductor pins 74*a*, 74*b*, 74*c* extend out of the module 28 through open slots 76 in the horizontal wall 60. The pin 74*a* spaced farthest from the vertical wall 54, however, extends from the module 28 farther than the other pins 74*b* and 74*c*. The conductor pins 74*a*, 74*b*, 74*c* are spaced apart a predetermined distance along a straight line extending away from the vertical wall 54 and define a linear pin array or pin field 77.

Base portion 48 includes a bottom wall 78 that extends along the bottom of the module 28, an end wall 80, and a horizontal wall 82 joining the lower wall 56 and the end wall 80. Bottom wall 78 supports the module 28 against the rail flanges 26', 26" and defines a "T" slot 84 and an "L" slot 86 that receive the DIN latch 18. A hook 88 extends from end wall 80 below the bottom wall 78 to fit over the DIN rail flange.

Horizontal walls 56 and 82 are spaced above the bottom wall 78. A center web 90 (see also FIG. 10) extends between walls 56, 82 and the bottom wall 78 for added rigidity. Vertical support pillars 92*a*, 92*b*, 92*c*, and 92*d* extend between the wall 56 and the bottom wall 78 across the full width of the module 28. Pillar 92*a* is directly beneath front housing end wall 58.

A rear wall 94 adjacent to end wall 80 extends upwardly from the wall 82. A pivotable rear latch arm 96 connected to the rear wall 94 carries a latch finger 98 that extends over the rear wall 94. Latch finger 98 includes a bore 97 and a plug 99 (similar to bore 40 and plug 42) that cooperate with adjacent pins or bores of an adjacent module or endplate to interconnect the latch fingers 98 when module 28 forms part of the terminal housing 12.

The conductors 44*a*, 44*b*, 44*c* are nested when installed, with the horizontal conductor segments 70*a*-70*c* parallel with one another and the vertical conductor segments 72*a*-72*c* parallel with one another.

The lead segment 68 of each conductor 44 is threaded through a receptacle 24 in a conventional manner that supports the forward end of the conductor.

Conductor 44*a* is installed in the module housing 46 between wall 56 and a horizontal wall 100. Conductor 44*b* is installed between wall 100 and a horizontal wall 102. Conductor 44*c* is installed between wall 102 and wall 60. Walls 100, 102 are located in the interior of the front housing 46 and extend from the sidewall 50 the full width of the module 28. The horizontal segment 70*a* of the conductor 44*a* is supported on the bottom wall 56 of the front housing 46. The horizontal segments 70*b*, 70*c* of the other conductors 44*b*, 44*c* are supported on wall 100 and wall 102 respectively.

Vertical walls 101, 103 also separate the vertical segments 72 of the conductors 44. Wall 101 is directly over the support pier 92*b*. Wall 103 is directly over the support pier 92*c*. Walls 101, 103 are spaced above respective horizontal walls 100 and 102 and extend vertically to the wall 60. Walls 101, 103 are located in the interior of the front housing 46 and extend from the sidewall 50 the full width of the module 28. The vertical segment 72*a* of the conductor 44*a* is between walls 58 and 101 and the vertical segment 72*b* of the conductor 44*b* is between walls 101 and 103.

Each wall 56, 100, and 102 includes a number of like support standoffs that locate and support the conductors between the walls. See FIG. 10. Each standoff extends from the sidewall 50 towards the opposite side of the module, and includes a tapered face facing the open side of the module to help guide the conductor into the module during installation.

Wall 56 includes three spaced-apart standoffs 104*a*, 104*b*, and 104*c*. Standoffs 104*a*-104*c* are each located on the upper side of the wall 56 immediately above a respective support pier 92*b*, 92*c*, and 92*d*.

Wall 100 includes three standoffs 106*a*, 106*b*, and 106*c* that extend proud of both sides of the wall 100 to face walls 56 and 102. Standoffs 106*a*, 106*b* are a closely spaced pair of standoffs, with standoff 106*a* directly above pier 92*c*. Standoff 106*c* is spaced from standoffs 106*a*, 106*b* and is directly above pier 92*d*.

Wall 102 includes a pair of closely-spaced standoffs 108*a*, 108*b* that extend proud of both sides of wall 102 and face walls 100 and 60. Standoff 108*a* is directly above pier 92*d*.

Wall 60 includes a standoff 118 that extends from the lower side of the wall 60. Standoff 118 faces wall 102 and is directly above pier 92*d*.

Figure 11:
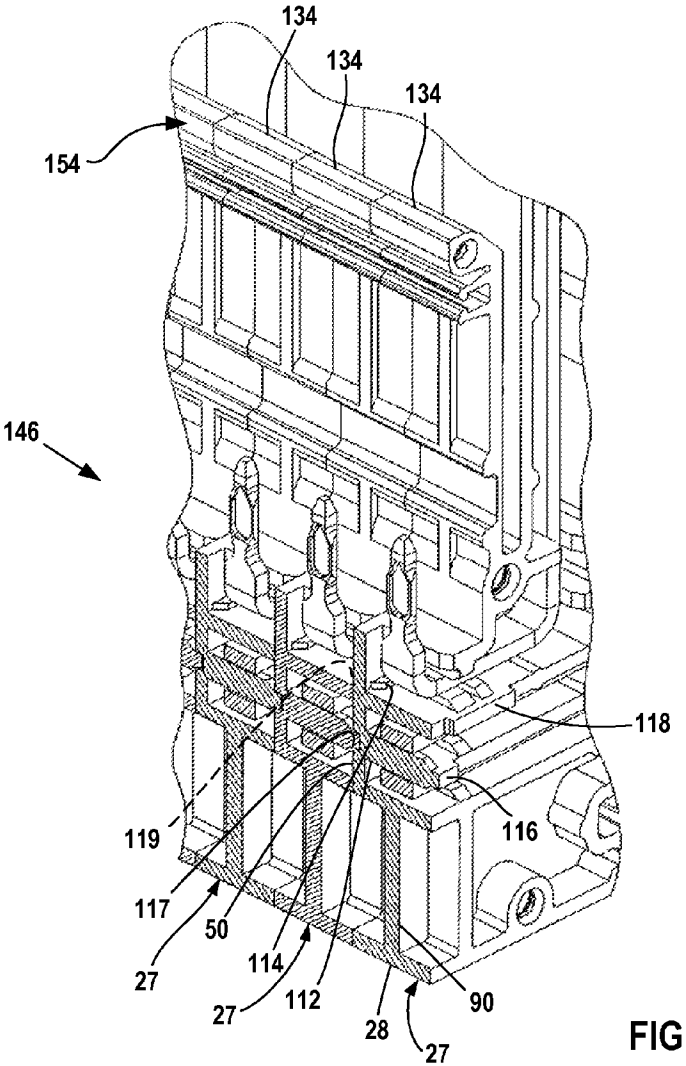
FIG. 11 is similar to FIG. 10 but illustrates several of the module assemblies assembled side-by-side to form part of the module stack.

Similar thickened wall portions 112, 114 interconnect the ends of closely spaced pairs of standoffs 106*a*, 106*b* and 108*a*, 108*b* (see FIG. 11). Wall portions 112, 114 each extend from sidewall 50 and extend a short distance beyond the sides of the standoffs 106*a*, 106*b* or 108*a*, 108*b* on both sides of the walls 100 or 102.

The standoffs resist vertical displacement of the conductors 44. Conductor 44*a* is sliding-fit between standoffs 104 and 106. Conductor 44*b* is sliding-fit between standoffs 106 and 108. Conductor 44*c* is sliding-fit between standoffs 108 and standoff 118. The slide-fits between the conductors 44 and standoffs 104, 106, 108 resist vertical displacement of the conductors 44 yet enable lateral freedom of movement of the conductors towards and away the sidewall 50.

Walls 100 and 102 include a respective end tab 116 and 118 that each extends away from the side of the wall adjacent the open side of the module. Tab 116 is adjacent the standoffs 106*a*, 106*b* and above pier 92*c*. Tab 118 is adjacent the standoffs 108*a*, 108*b* and above pier 92*d*. The standoffs do not extend to the tabs 116, 118. Similar slots 117, 119 (shown in FIG. 11) are formed in the sidewall 50 and are aligned with the tabs 116, 118 respectively.

Each conductor pin 74 includes a narrowed neck portion 122 adjacent the wall 60 and a contact portion 124 that extends away from the neck to a tapered upper end 126. Contact portion 124 includes a pair of spaced apart, vertically elongate contact surfaces 128. In the illustrated embodiment the neck portion 122 spaces the contact portion 124 slightly more than one millimeter above the wall 60.

The outermost conductor pin 74*a* also includes a second neck portion 130 formed between the contact portion 124*a* and the upper end 126*a*. Neck portion 130 spaces upper end 126*a* of conductor pin 74*a* above the upper ends 126*b* and 126*c* of the other two conductor pins 74*b*, 74*c*.

Module 28 includes a rigid standoff member 132 that extends from the wall 60 between the innermost pin 74*c* and the vertical wall 54. Standoff member 132 extends upwardly beyond pins 74*b*, 74*c*. A cover member 134 is attached to the standoff member 132 and extends away from the standoff member. Cover member 134 is connected to the standoff member by a flexible hinge 136. Standoff member 132, cover member 134 and hinge 136 extend the full width of the module 28 between sides 34, 36.

When the hinge 136 is unstressed, cover member 134 extends generally parallel to the wall 54. Hinge 136 enables the cover member 134 to fold away from the wall 54 towards the pins 74. Hinge 136 is preferably formed as a reduced thickness or relatively thin web of material between the support member 132 and the cover member 134 as shown.

Cover member 134 includes a cover finger 138 on its free end and a pair of barbed teeth 140 spaced inwardly from the finger 138. Cover finger 138 includes a bore 142 and a plug 144 (similar to bore 40 and plug 42) that cooperate with adjacent plugs or bores of the adjacent module or endplate to interconnect the cover members 134 of the terminal housing 12.

Assembly of the terminal housing 12 from a set of module assemblies 27 is described next. The conductors 44 and receptacles 24 are installed in each of the modules 28 to form the set of module assemblies 27. The modules 28 of the module assemblies 27 are then aligned and pressed together side-by-side to form a module assembly 146 shown in FIGS. 11 and 12. Modules 28 are connected side-by-side along the length of the modular assembly 146. Module plugs 42 are received in the module bores 40 to align the modules 28. Bores and plugs 40, 42 are sized to form interference fits resisting separation of the assembled modules.

Tabs 116, 118 of module walls 100 and 102 are also closely received into the slots 117, 119 of adjacent modules 28 as shown in FIG. 11. The module sidewalls 50 support the tabs 116, 118 and support the tabbed ends of the module walls 100, 102. The other ends of the module walls 100, 102 are supported by the sidewall 50 from which they extend or cantilever. In this way the walls 100, 102 of the modules 28 are supported on both ends when the module assembly 146 is assembled (with the exception of the exposed walls 100, 102 on the module located on one end of the module assembly 146).

Latch plugs 99 are received in latch bores 97 and connect adjacent latch arms 96. Cover plugs 144 are received in cover bores 142 and connect adjacent cover members 134.

The walls 60 and 94 of the individual modules 28 combine to define vertical wall 148 and horizontal wall 150 respectively extending the length of the module assembly 146. The connected latch arms 96 and connected cover members 134 combine to define a latch 152 and a cover 154 respectively. Both the latch 152 and the cover 154 extend the length of the module assembly 146. The latch fingers 98 are spaced above the wall 148 when the latch 152 is unstressed. The cover members 134 extend perpendicular to the wall 150 and parallel to the rear wall 54 when the cover 154 is unstressed.

The module pin fields 77 together define a rectangular pin field 156 in which the pins 74 are arranged in rows and columns. The nominal column spacing between adjacent pin fields 77 is equal to the nominal thickness of a module 28.

Circuit board 14 is mounted on the module assembly 146 preferably by automated machinery prior to attaching the end plates 30, 32 Manufacturing tolerances, however, accumulate with the number of modules 28 making up the module assembly 146. The overall distance between the pin fields 77 on opposite sides of a module assembly 146 varies among module assemblies 146 due to these manufacturing tolerances, making it difficult for automated machinery to reliably mount the circuit boards 14 on the module assemblies 146.

An alignment plate 158 is used to accurately position the pins 74 within the pin field 156 despite variations in pin locations due to manufacturing tolerances and unavoidable variations in thickness of the modules 28. See FIGS. 12-14. Alignment plate 158 is fitted on the pin field 156 to engage and accurately position the pins 74 within the pin field 156 prior to attaching the circuit board 14.

Alignment plate 158 is preferably formed from non-conducting plastic and includes generally flat, parallel lower and upper sides 160, 162 separated by the thickness of the plate. The plate thickness is substantially less than the distance which the pins 74 extend out of the modules 28.

Alignment plate 158 includes a number of through-holes 164 extending through the thickness of the plate that receives the pins 74. Holes 164 are arranged in the identical rectangular arrangement as the vias in the printed circuit board 14. Plate holes 164 are arranged as rows and columns with row and column spacings identical to those of the vias of the printed circuit board 14.

Figure 12:
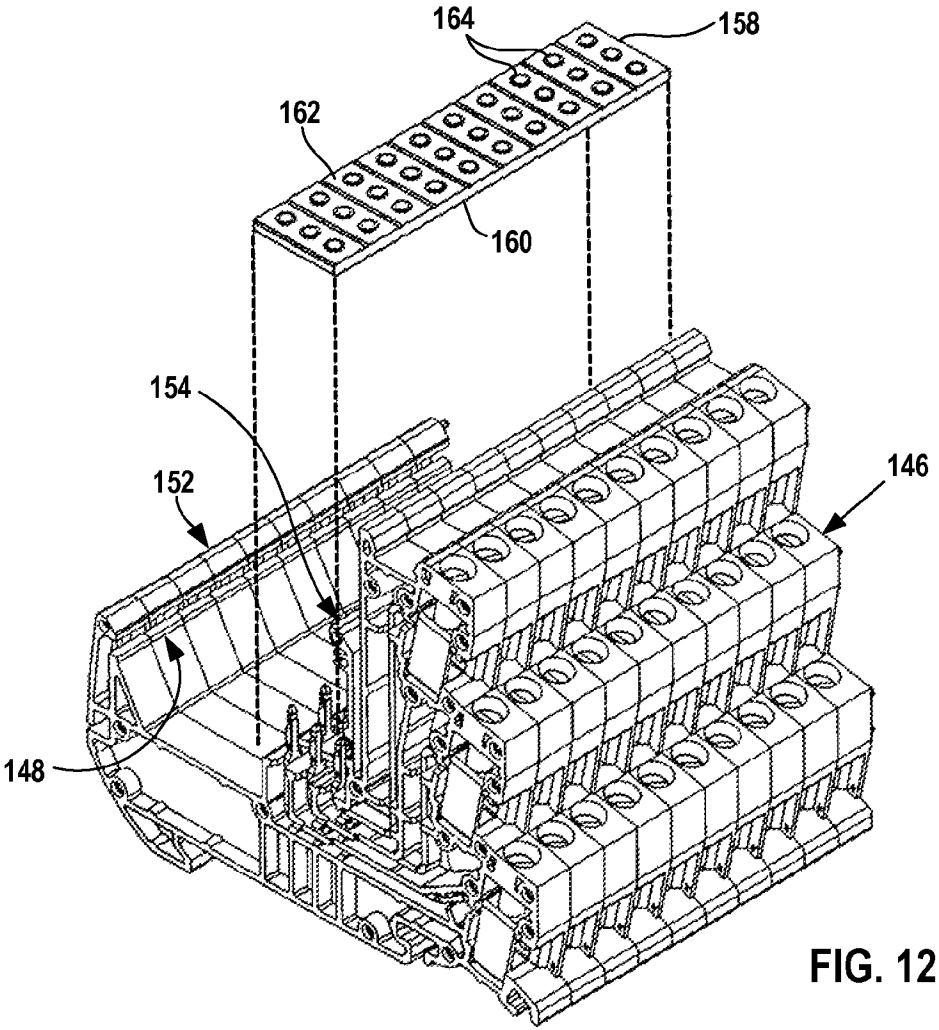
FIG. 12 illustrates the module stack and alignment plate aligned with the conductors of the module stack prior to installation of the alignment plate.
Figure 13:
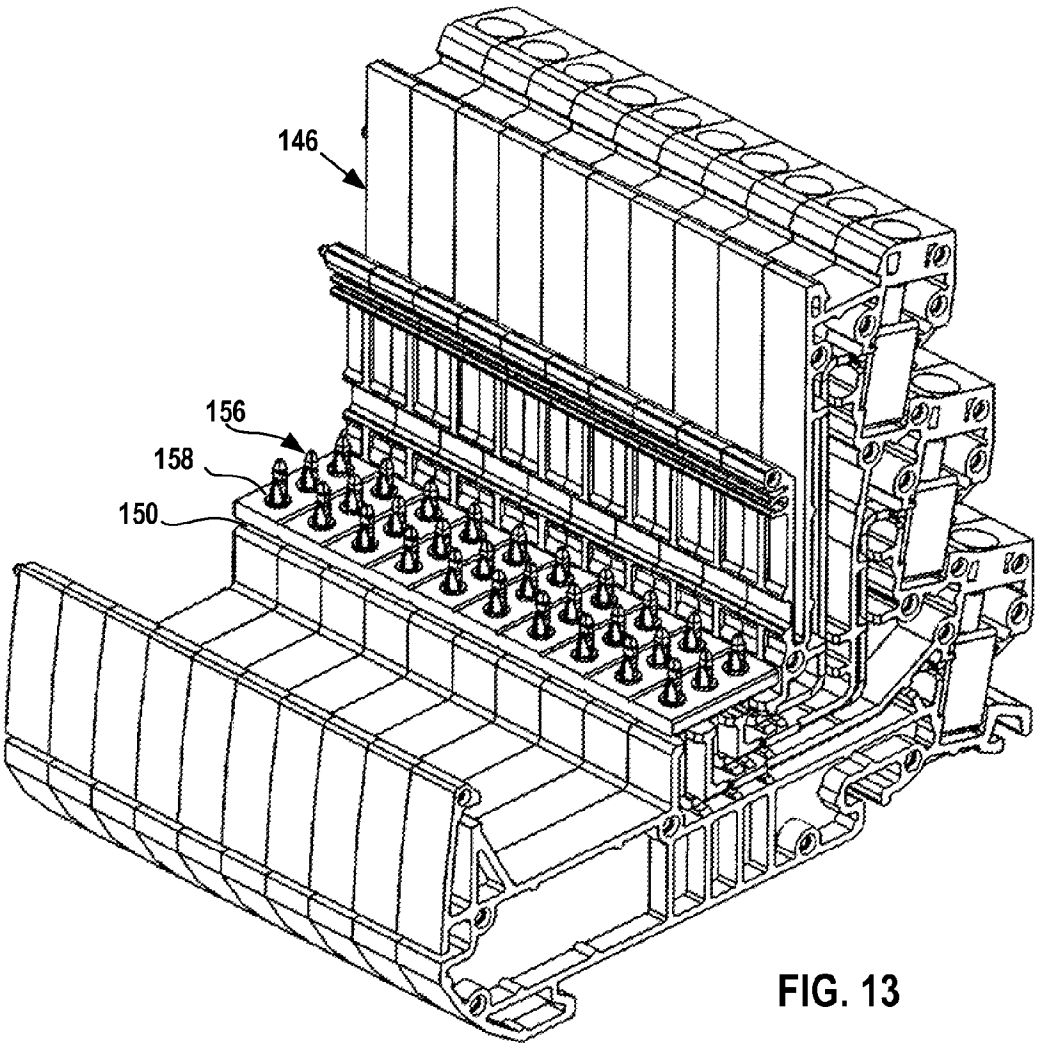
FIG. 13 illustrates the alignment plate installed on the module stack to locate the conductors of the module stack.
Figure 14:
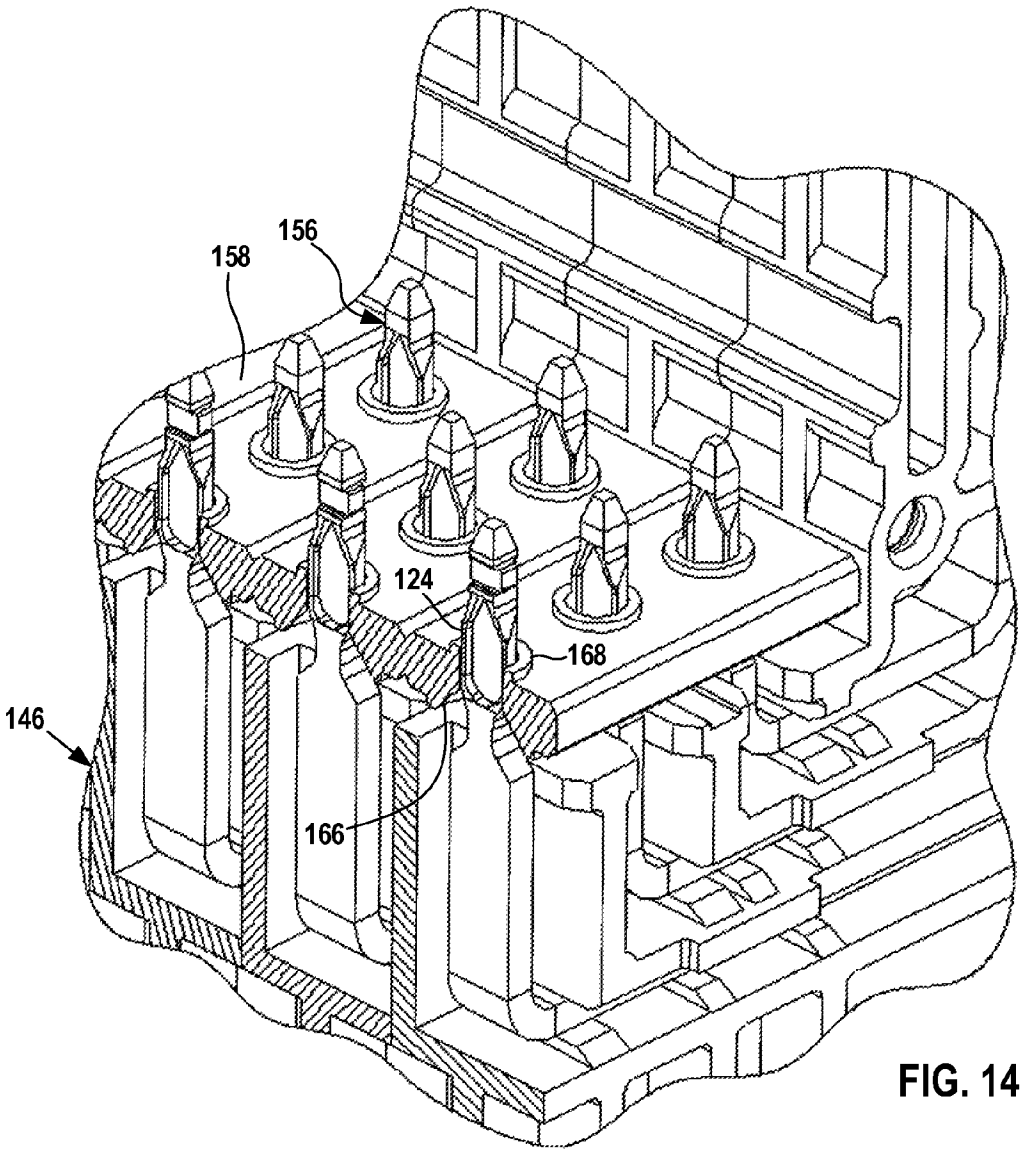
FIG. 14 is an enlarged partial section view similar to FIG. 11 but with the alignment plate installed as shown in FIG. 13.

Alignment plate 158 is placed above the pin field 156 with the plate holes 164 over the corresponding pins 74 as shown in FIG. 12. The plate 158 is maintained parallel with the horizontal wall 150 and moves towards the wall 150 to receive the pins 74 within the plate holes 164. Alignment plate 158 is moved towards the wall 150 until it is positioned in a standby position slightly above the wall 150 as shown in FIGS. 13 and 14.

Plate holes 164 include chamfers or enlarged openings 166 on the lower side 160 of the alignment plate 158. Bosses 168 surround each plate hole 164 on the upper side 162 of the plate. The enlarged openings 166 and the tapered upper ends 126 of the conductor pins 74 cooperate to guide or funnel the pins into the plate holes 164. The conductors 44 within a module 28 can move a limited distance towards either side of the module 28 to enable the pins 74 to align with and enter the plate holes 164.

In the illustrated embodiment the alignment plate 158 is spaced one millimeter above the wall 150 when the plate is in the standby position. The contact portions 124 of the pins 74 are located just above the openings 166 and extend out of the plate 158 as shown in FIG. 14. The plate holes 164 are sized to receive the pin contact portions 124 with a light press fit that holds the alignment plate 158 in the standby position on the pins 74 and accurately positions the pins 74 in the alignment plate 158.

Figure 16:
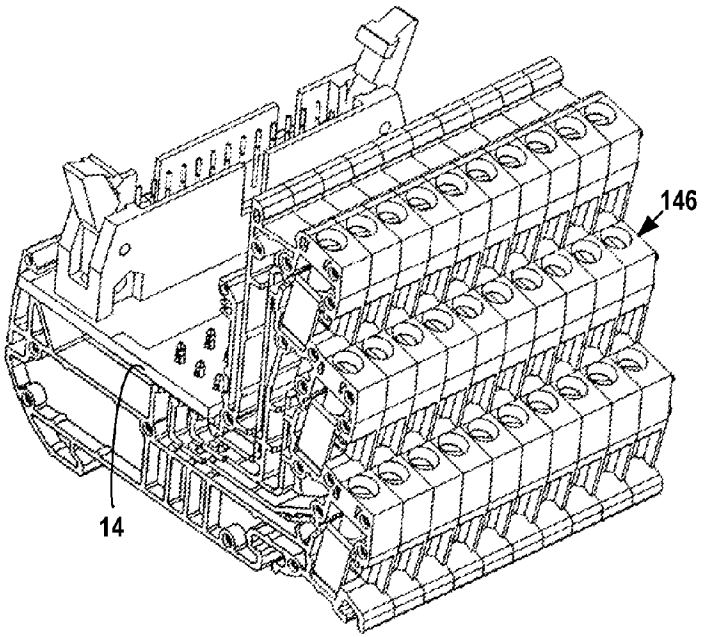
FIG. 16 illustrates the printed circuit board installed on the module stack and the alignment plate against the module stack.
Figure 15:
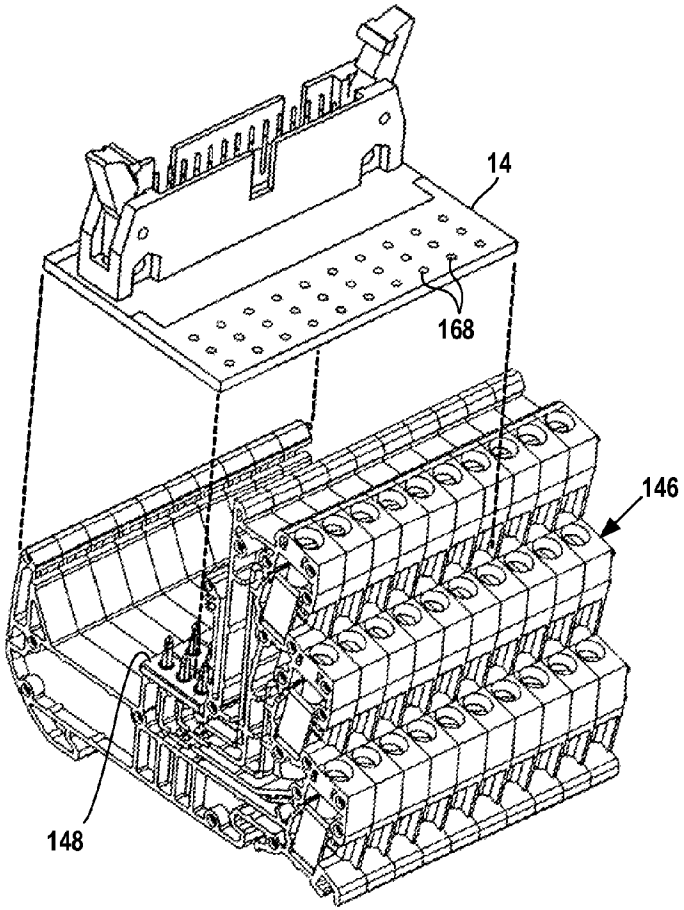
FIG. 15 illustrates the printed circuit board of the terminal block aligned with the conductors of the module stack prior to installation of the printed circuit board.

The circuit board 14 is installed on the module stack 146 after the alignment plate 158 is in its standby position. See FIGS. 15 and 16. The circuit board 14 has vias 168 that receive the pins 74 to electrically interconnect the circuit board 14 with the terminals 26. The illustrated vias 168 are arranged in a rectangular array.

The circuit board 14 is placed above the module stack 146 with the vias 168 aligned with the pins 74. The alignment plate 158 has accurately positioned the pins 74 to match the arrangement of the vias 168 as previously described. The latch 152 is pivoted to move the latch 152 away from the wall 148.

Circuit board 14 is lowered against the alignment plate 158, with the conductor pins 74 received into the vias 168. The circuit board 14 presses down against the alignment plate 158 until the alignment plate 158 seats against the horizontal wall 150. The alignment plate 158 and the wall 150 support the forward end of the circuit board 14. The back end of the circuit board 14 is supported against the wall 148. Latch 152 is pivoted back to its original position so that the latch fingers 98 secure the back end of the circuit board 14 against the wall 148.

Figure 17:
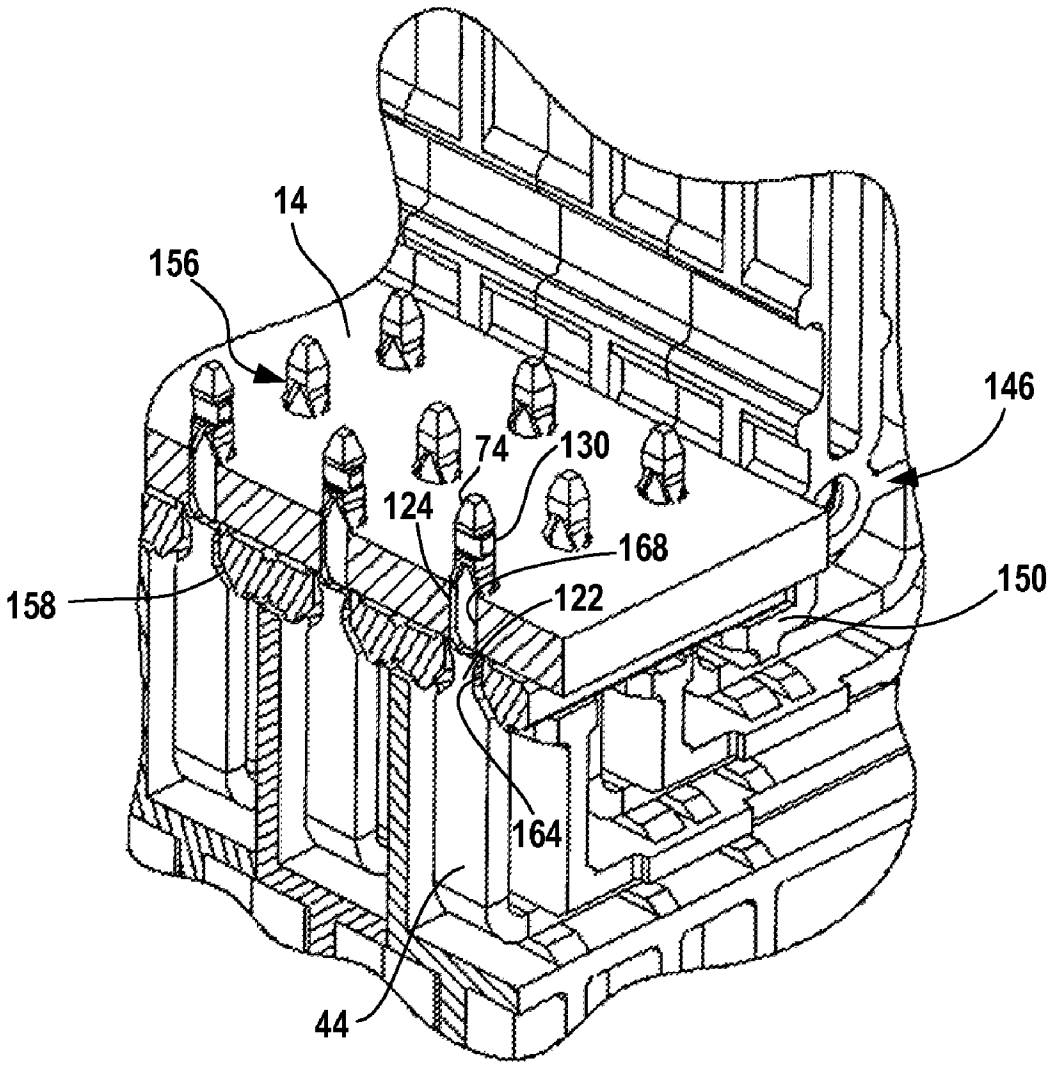
FIG. 17 is an enlarged partial sectional view similar to FIG. 14 but with the printed circuit board and alignment plate installed as shown in FIG. 16.

FIG. 17 illustrates the pins 74 in the alignment plate 158 and the circuit board 14 after the circuit board 14 is mounted on the module stack 146. The pins 74 extend through both the alignment plate 158 and the circuit board 14, with the upper ends of the pins 74 spaced above the circuit board 14. The second neck portions 130 of the outermost pins 74*a* are also above the circuit board 14.

The pin contact portions 124 form press fits with the inner walls of the vias 168, thereby electrically connecting the conductor pins 74 and the vias 168.

When the alignment plate 158 is moved from its standby position to against the wall 150, the alignment plate 158 moves past the pin contact portions 124. The pin necks 122 are received within the alignment plate holes 164 with clearance so that the pins 74 do not touch or engage the alignment plate 158. The alignment plate 158 essentially "floats" with respect to the pins 74 and does not apply force to the pins of the pin field 156.

The press fits formed when installing the alignment plate 158 and the circuit board 14 on the module 146 transmit vertical loads to the conductors 44. These vertical loads are in turn transmitted by the conductors 44 through the supports 104, 106, and 108 to the horizontal module walls 56, 100, and 102. Module walls 100 and 102 are supported on both ends as described previously above to support the conductors and resist deflection of the conductors 44 caused by these vertical loads. Furthermore, the standoff members 104, 106, 108 and the tabs 116, 118 are positioned over the support piers 92*b*, 92*c*, 92*d* and transmit the vertical forces to the support piers and ultimately to the bottom wall 78.

Additionally, vertical loads that may be applied to the wall 150 during assembly are also be transmitted through the vertical walls 58, 101 and 103 to the bottom wall 78 through the conductors 44, standoff members 104, 106 and the support piers 92*a*, 92*b*, and 92*c*.

Figure 19:
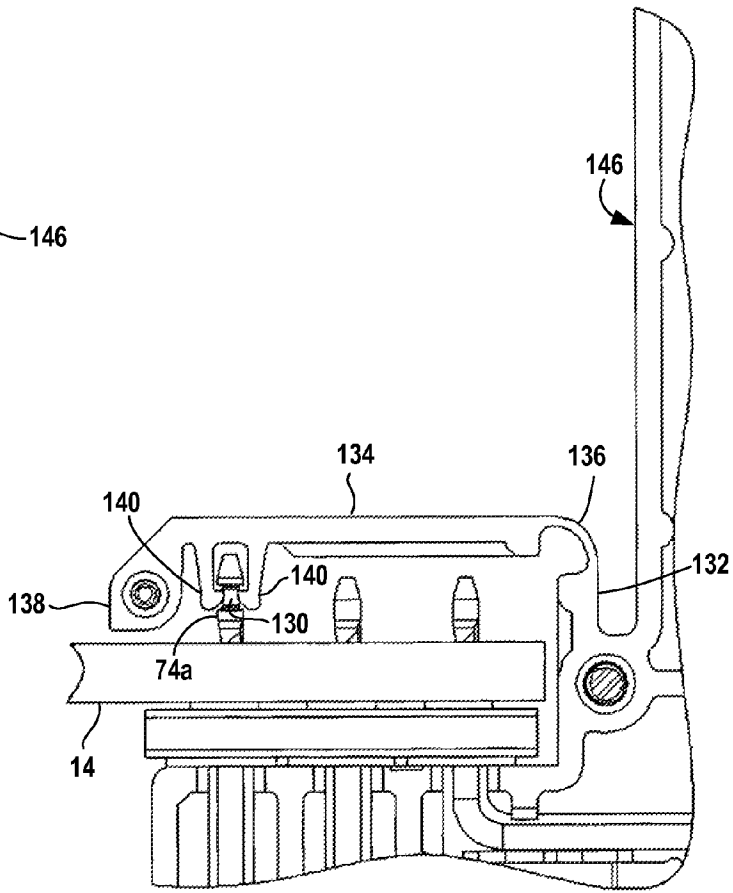
FIG. 19 is similar to FIG. 18 but illustrates the contact cover in its closed position.
Figure 18:
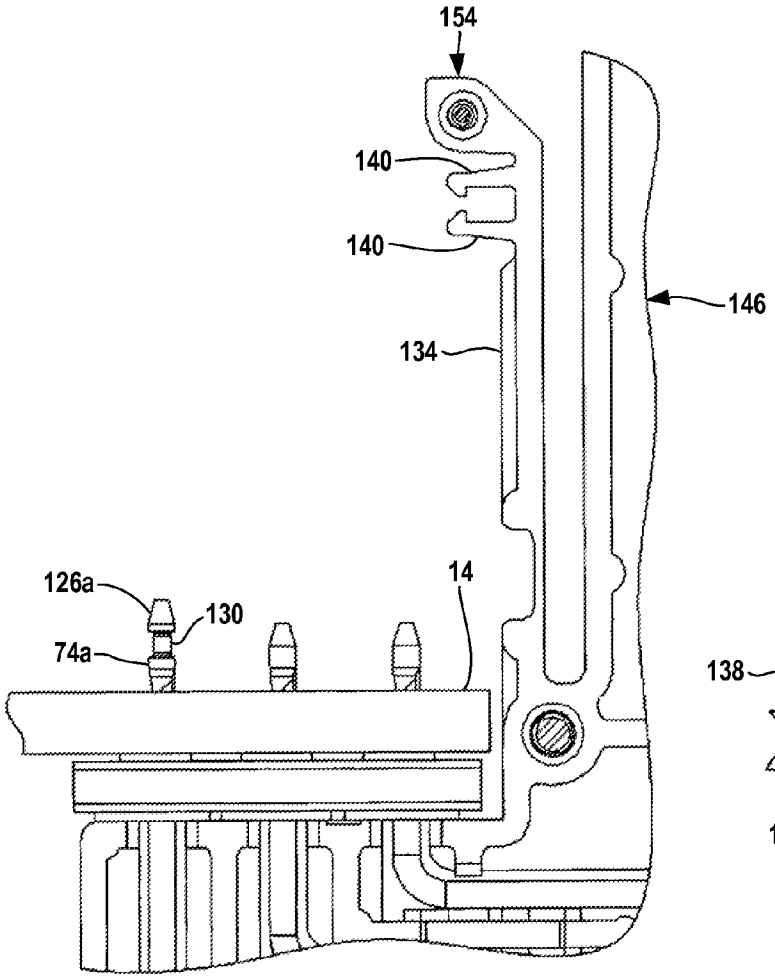
FIG. 18 is a partial side view of the module stack with the alignment plate and printed circuit board installed and the contact cover in its opened position.

After the circuit board 14 is installed on the module assembly 146, the cover 154 is folded and lowered against the circuit board 14 to cover the exposed contact pins 74. FIGS. 18 and 19 illustrate the cover 154 before and after closing. Hinges 136 extending along the cover 154 flex as the cover 154 folds towards the circuit board 14. The upper ends 126*a* of the conductor pins 74*a* are received between the sets of cover teeth 140. The ends 126*a* force the pairs of teeth apart slightly as the pins 74*a* enter between the teeth. The pairs of teeth move back together when the barbs reach the second neck portions 130 with the cover 154 in an essentially horizontal position parallel with the circuit board 14. The teeth barbs hold the cover 154 closed against the pins 74*a*.

Each cover member 134 forming cover 154 engages a respective conductor pin 74*a* with teeth 140 so that the cover 154 is held closed at multiple, closely spaced points along its length. The cover fingers 138 are closely spaced from the circuit board 14 when the cover is closed.

DIN latch 18 is fitted into the "T" and "L" slots extending the length of the module stack 146 and the end plates 30, 32 are attached to complete assembly of the terminal block 10. The end plates 30, 32 each includes a cover plate 170 (see FIG. 5) that extends over the adjacent cover member 134 to extend over the side edges of the cover 154. The end plates 30, 32 also include plugs that extend into the bores of the one adjacent module 28, and slots as needed to receive the plugs, pins, and tabs extending from an adjacent module 28.

Each illustrated module assembly 27 includes three receptacles 24 and three conductors 44. In other embodiments a module assembly can carry more or fewer receptacles and conductors. Different types of receptacles and different arrangements of receptacles within a module can also be used in other embodiments. It is not necessary that the receptacles be identical in each module or in a terminal housing.

While I have illustrated and described a preferred embodiment of my invention, it is understood that this is capable of modification, and I therefore do not wish to be limited to the precise details set forth, but desire to avail myself of such changes and alterations as fall within the purview of the following claims.

I claim:

1. A module assembly for forming a terminal housing for a modular terminal block, the module assembly comprising:

a module, means for aligning the module with a second module for forming at least part of a terminal housing, at least one conductor extending out of the module to an exposed conductor end portion, a cover member, a cover retention member, and a connection movably connecting the cover member with the module;

the cover member movable between a first position away from the at least one conductor end and a second position over the at least one conductor end;

the cover retention member engagable with the cover member when the cover member is in the second position to retain the cover member in said second position;

wherein the cover retention member is one of the at least one conductor end portions.

2. The module assembly of claim 1 wherein the at least one conductor comprises a plurality of conductors, the cover member over the plurality of conductor end portions when in the second position.

3. The module assembly of claim 1 wherein the connector comprises a standoff member attached to the module and a hinge foldably connecting the cover member to the standoff member.

4. The module assembly of claim 1 wherein the cover member, connector, and module are formed as an integral, one-piece unit.

5. A module assembly for forming a terminal housing for a modular terminal block, the module assembly comprising:

a module, means for aligning the module with a second module for forming at least part of a terminal housing, at least one conductor extending out of the module to an exposed conductor end portion, a cover member, a cover retention member, and a connection movably connecting the cover member with the module;

the cover member movable between a first position away from the at least one conductor end and a second position over the at least one conductor end;

the cover retention member engagable with the cover member when the cover member is in the second position to retain the cover member in said second position;

wherein the said one conductor end portion and the cover member comprise cooperating retention surfaces that engage one another when the cover member moves from the first position to the second position.

6. The module assembly of claim 5 wherein the cover member comprises spaced apart teeth that receive the said one conductor end portion when the cover member is in the second position, the cover member retention surfaces on said teeth.

7. A module assembly for forming a terminal housing for a modular terminal block, the module assembly comprising:

a module, means for aligning the module with a second module for forming at least part of a terminal housing, at least one conductor extending out of the module to an exposed conductor end portion, a cover member, a cover retention member, and a connection movably connecting the cover member with the module;

the cover member movable between a first position away from the at least one conductor end and a second position over the at least one conductor end;

the cover retention member engagable with the cover member when the cover member is in the second position to retain the cover member in said second position;

wherein the at least one conductor comprises a plurality of conductors, the cover member over the plurality of conductor end portions when in the second position; and wherein one conductor end portion extends from the module farther than the other conductor end portions and the cover retention member is the one conductor end portion.

8. The module assembly of claim 7 comprising a standoff member attached to the module and extending from the module farther than the said other conductor end portions, the cover on said standoff member.

9. A module assembly for forming a terminal housing for a modular terminal block, the module assembly comprising:

a module, means for aligning the module with a second module for forming at least part of a terminal housing, at least one conductor extending out of the module to an exposed conductor end portion, a cover member, a cover retention member, and a connection movably connecting the cover member with the module;

the cover member movable between a first position away from the at least one conductor end and a second position over the at least one conductor end;

the cover retention member engagable with the cover member when the cover member is in the second position to retain the cover member in said second position;

wherein the cover member comprises means for interconnecting with the cover member of an adjacent module when forming part of a terminal block for conjoint movement of the cover members from the first and second positions.

10. A terminal housing of a modular terminal block comprising:

a plurality of like conductor housings arranged side-by-side along an axis, at least one conductor in each housing and projecting out of the housing to an exposed conductor end portion;

each housing comprising a cover member and a connection movably mounting the cover member to the housing, the cover member movable between an opened position and a closed position to cover the conductors extending from the housing;

each cover member comprising an interconnect member for engaging a corresponding interconnect member on an adjacent cover member for conjoint movement of the cover members, the cover members forming a cover movable between open and closed positions; and a plurality of spaced-apart cover retention members, each cover retention member attached to a respective housing and engageable with the cover member of said housing when the cover moves from the open to the closed position to retain the cover in the closed position, whereby the cover retention members retain the cover in the closed position at multiple points along the axial length of the cover.

11. The terminal housing of claim 10 wherein the number of cover retention members equals the number of housings.

12. The terminal housing of claim 10 comprising end plates attached to respective ends of the set of housings, each end plate comprising means for retaining the cover member of the adjacent housing in its closed position.

13. The terminal housing of claim 10 wherein each cover member includes a plug interconnect member on one side of the cover member and a bore interconnect member on the other side of the cover member, the plug interconnect member engaging a bore interconnect member on another cover member on said one side of the cover member and the bore interconnect member engaging a plug interconnect member on a further cover member on said other side of the cover member.

14. The terminal housing of claim 10 wherein the cover retention members are each formed from a respective one of the conductors extending from the housings.

15. The terminal housing of claim 14 wherein the number of cover retention members equals the number of housings, each respective one of the conductors extending from a different housing.

* * * * *